US008783597B2

(12) United States Patent
Nagler

(10) Patent No.: US 8,783,597 B2
(45) Date of Patent: Jul. 22, 2014

(54) SYSTEM FOR EVENLY WINDING A HOSE ON A REEL

(75) Inventor: Ehud Nagler, Kiryat Tivon (IL)

(73) Assignee: Hydro-Industries Tynat Ltd., Afula (IL)

( * ) Notice: Subject to any disclaimer, the term of this patent is extended or adjusted under 35 U.S.C. 154(b) by 0 days.

(21) Appl. No.: 11/808,512

(22) Filed: Jun. 11, 2007

(65) Prior Publication Data

US 2007/0241224 A1 Oct. 18, 2007

Related U.S. Application Data

(63) Continuation-in-part of application No. 10/941,877, filed on Sep. 16, 2004, now abandoned.

(51) Int. Cl.
*B65H 75/44* (2006.01)
*B65H 75/34* (2006.01)
*B65H 75/40* (2006.01)

(52) U.S. Cl.
USPC ..... 242/397.2; 242/397.5; 242/403; 137/355.12; 137/355.27

(58) Field of Classification Search
CPC ..... B65H 75/4405; B65H 75/4494; B65H 75/4492
USPC ..... 242/397, 397.2–397.5, 403; 137/355.12, 355.22, 355.26, 355.27
IPC ..... B65H 75/44, 75/26, 75/34
See application file for complete search history.

(56) References Cited

U.S. PATENT DOCUMENTS

| | | | | |
|---|---|---|---|---|
| 913,564 | A * | 2/1909 | Riblet | 212/89 |
| 1,797,331 | A * | 3/1931 | Dale | 242/397.3 |
| 2,001,478 | A | 5/1935 | Vogt | |
| 2,170,459 | A * | 8/1939 | Motkowicz et al. | 242/396.5 |
| 2,348,987 | A * | 5/1944 | Lock | 242/157.1 |
| 2,518,990 | A | 8/1950 | Keener | |

(Continued)

FOREIGN PATENT DOCUMENTS

| | | | | |
|---|---|---|---|---|
| DE | 10300960 | A1 * | 7/2004 | B65H 75/44 |
| GB | 2063661 | A * | 6/1981 | B60S 1/56 |
| JP | 61-192673 | | 8/1986 | |
| WO | WO 2006/030428 | | 3/2006 | |

OTHER PUBLICATIONS

EPO, Machine Translation, DE10300960A1, Jan. 4, 2013, pp. 6-7.*

(Continued)

*Primary Examiner* — William A Rivera
*Assistant Examiner* — Stefan Kruer

(57) ABSTRACT

A device for evenly winding a hose on a reel is provided, comprising, (1) a static shaft; (2) a pulley, adapted to move along the shaft, in an oscillatory motion in ±x directions, and further adapted to receive the hose, be made to rotate by the hose, and convert a motion of the hose, in a direction substantially orthogonal to the x-axis, to a rotation of the pulley, and as a result of the rotation, to the oscillatory motion in the ±x directions; and (3) a pulley housing, configured for containing the hose within and further configured for moving along the shaft with the pulley, thus ensuring that the hose travels with the pulley, in the oscillatory motion along the shaft. Additionally, the system may include a mechanism, configured for engaging the hose with the shaft, without impeding the even winding motion.

18 Claims, 21 Drawing Sheets

(56) References Cited

U.S. PATENT DOCUMENTS

| | | | | | |
|---|---|---|---|---|---|
| 2,898,605 | A | | 8/1959 | Pearson | |
| 2,921,743 | A | | 1/1960 | Westover et al. | |
| 3,381,317 | A | | 5/1968 | Daniels et al. | |
| 3,471,885 | A | | 10/1969 | McLoughlin et al. | |
| 3,545,013 | A | | 12/1970 | Discoe | |
| 3,576,196 | A | * | 4/1971 | Atanosian | 137/355.26 |
| 3,809,334 | A | * | 5/1974 | Beurer et al. | 242/397.3 |
| 3,879,770 | A | | 4/1975 | Grant | |
| 3,939,862 | A | | 2/1976 | Booth | |
| 4,010,916 | A | * | 3/1977 | Swain | 242/157.1 |
| 4,492,372 | A | | 1/1985 | Lorence et al. | |
| 4,616,791 | A | | 10/1986 | Harvey et al. | |
| 4,777,976 | A | * | 10/1988 | Johnston et al. | 137/355.27 |
| 5,381,820 | A | | 1/1995 | Chandler | |
| 5,385,314 | A | * | 1/1995 | Hughes | 242/397.3 |
| 5,741,188 | A | | 4/1998 | Levin et al. | |
| 6,050,290 | A | | 4/2000 | Yacobi et al. | |
| 6,338,360 | B2 | | 1/2002 | Spear et al. | |
| 6,371,148 | B1 | | 4/2002 | Tripp | |
| 6,752,342 | B1 | | 6/2004 | Nagler | |
| 6,908,058 | B2 | | 6/2005 | Moon et al. | |
| 6,971,605 | B1 | | 12/2005 | Martin | |
| 6,974,103 | B1 | | 12/2005 | Pansini | |
| 2005/0116079 | A1 | * | 6/2005 | Stevens | 242/419.5 |
| 2006/0054731 | A1 | | 3/2006 | Nagler | |
| 2006/0144986 | A1 | * | 7/2006 | Tsai | 242/397.2 |

OTHER PUBLICATIONS international Preliminary Report on Patentability Dated Mar. 29, 2007 From the International Bureau of WIPO Re.: Application No. PCT/IL2005/000974.

Official Action Dated Feb. 13, 2007 From the US Patent and Trademark Office Re.: U.S. Appl. No. 10/941,877.

* cited by examiner from
DE 10 10 960 A1 2004.07.22

Pan-Air
Boom
DE 103 00 601 A1

F
F v
α
55
F FRICTION
51
N
58
W
12

F
F v
α
55
F FRICTION
58
N
53
W
12

125
104
102
106
103
107

125
104
102
104
112
107
114
103
78 z
y
x
76
56
52
112
102
104
125
66
64
54
100
74
78
68
82
58
72
114

125
104
102
112
103
76
114

125
104
106
102
112
103
78
114

SYSTEM FOR EVENLY WINDING A HOSE ON A REEL

CROSS REFERENCE TO RELATED APPLICATIONS

This application is a continuation-in-part of pending U.S. patent application Ser. No. 10/941,877 filed on Sep. 16, 2004, whose disclosure is incorporated herein by reference.

FIELD AND BACKGROUND OF THE INVENTION

The present invention relates to a system for evenly winding a hose on a reel, and more particularly to a system which employs the hose as a belt for the transmission of the evening motion.

FIG. 1 schematically illustrates a hose and reel system 10 comprising a hose 12 wound on a reel 14. The reel 14 defines a coordinate system of linear coordinates x;y;z and a rotation ρ around the x-axis, and is adapted for a rotation in the ρ direction, around the x-axis, for winding the hose 12 on the reel 14.

Additionally, the reel 14 defines first and second sides 16 and 18, respectively. In order for the hose 12 to wind evenly on the reel 14 and not pile up at one side or the other, when winding, the hose 12 is made to move in an oscillatory motion, in the ±x directions between sides 16 and 18, as shown by an arrow 15.

Various mechanisms are known for producing the oscillatory motion of hose 12, for even winding, as described by the arrow 15.

For example, FIGS. 2A and 2B schematically illustrate a rotating shaft system 20, for providing the oscillatory motion of the hose 12.

As seen in FIG. 2A, the rotating shaft system 20 has a shaft 22, having a length axis along the x-axis. The shaft 22 is threaded by two threads of substantially identical dimensions, but opposite directions: a first thread 24, being a right-hand external thread, is wound in the direction ρ, and a second thread 26, being a left-hand external thread, is wound in the opposite direction −ρ, on the shaft 22. At ends 25 and 27, the first thread 24 and the second thread 26 communicate, so that an element moving on the thread 24 in the −x direction, towards the first end 25, will reverse its direction, upon reaching the first end 25 and begin to move the +x direction, on the second thread 26. Similarly, upon reaching the second end 27, the element will again reverse its direction and begin to move in the −x direction, on the first thread 24.

A motion transmission mechanism 28, for example, a gear 28, causes the shaft 22 to rotate in a single direction around the x-axis, for example, in the direction ρ. A hose carrier 30 is mounted on the shaft 22 and is adapted to move along it, in the ±x directions, on the threads 24 and 26, as shown by the arrow 15. The hose carrier 30 includes a slide 32 which stabilizes it and ensures that the carrier 30 moves only in the ±x directions of the arrow 15. Additionally, the hose carrier 30 includes a hose seat 34 wherein the hose 12 (FIG. 1) is inserted. When inserted the hose 12 moves with the hose carrier 30 in the ±x directions of the arrow 15.

As seen in FIG. 2B, an element 36, enclosed within a cylindrical housing 44 and a cap 42, is adapted to engage with the groves of the first and second external threads 24 and 26, as the shaft 22 rotates. The element 36 has an arched segment 38, serving as an internal thread, which may engage either with the first external thread 24 or with the second external thread 26. As the shaft 22 rotates in the direction ρ, the element 36 moves along either the first or the second external threads 24 and 26, transferring between them at the first end 25 and the second end 27, thus moving in an oscillatory motion, first in the −x direction, along the first thread 24, then in the +x direction, along the second thread 26, and so on, repeatedly, causing the hose 12 to wind evenly on the reel 14.

FIG. 2C schematically illustrates a reel system 40, for evenly winding the hose 12 (FIG. 1) on the reel 14, as known. The reel system 40 includes the rotating shaft system 20 operative for winding the hose 12 on the reel 14 evenly. In accordance with the present example, a gear system 46 transfers motion from the reel 14, to the shaft 22, causing shaft 22 to rotate. It will be appreciated that a belt system or any other motion transfer system, as known, may similarly be used. The motion of the reel 14 may be provided by a motor, by hand, or by any other means, as known.

FIGS. 3A and 3B describe a device 200 for winding and unwinding a cord-like material 230, in accordance with German Patent Publication DE 103 00 960 of Jul. 22, 2004. The device 200 includes a drum 210, which may be rotated by a handle 214.

A shaft 222, mounted on a structure 250, and a pulley 220, configured to rotate around the shaft 222, and having a grove 224, are employed for evenly winding the cord-like material 230 on the drum 210. The shaft 222 includes an cross thread 223, formed as a counterclockwise thread 223L with a first gradient angle and a clockwise thread 223R with a second gradient angle.

By placing the cord-like material 230 in the groove 224 of the pulley 220, and turning the handle 214, the cord-like material 230 causes the pulley 220 to move in the ±x directions, which in turn causes the cable 230 to wind evenly on the drum 210.

A pressure plate 240, pressed against the pulley 220, ensures that the cord-like material 230 does slip out of the guide groove 224.

However, a disadvantage of the device 200 is that the pressure plate 240 increases the frictional forces between the pulley 220 and the shaft 222, thus impeding the motion of the pulley 220 along the shaft 222, in the ix directions.

A motion transfer system devoid of this limitation is desired.

SUMMARY OF THE INVENTION

The present invention successfully addresses the shortcomings of the presently known configurations by providing a system for evenly winding a hose on a reel, comprising, (1) a static shaft; (2) a pulley, adapted to move along the shaft, in an oscillatory motion in ix directions, and further adapted to receive the hose, be made to rotate by the hose, and convert a motion of the hose, in a direction substantially orthogonal to the x-axis, to a rotation of the pulley, and as a result of the rotation, to the oscillatory motion in the ±x directions; and (3) a pulley housing, configured for containing the hose within and further configured for moving along the shaft with the pulley, thus ensuring that the hose travels with the pulley, in the oscillatory motion along the shaft. Additionally, the system may include a mechanism, configured for engaging the hose with the shaft, without impeding the even winding motion.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 13 schematically illustrates the device of FIGS. 12A-12C, with the hose engaged;

DESCRIPTION OF THE PREFERRED EMBODIMENTS

Figure 1:
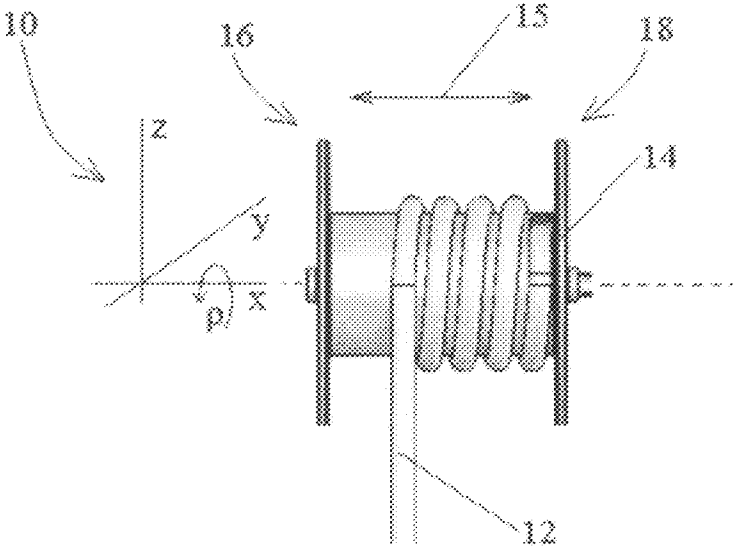
Figure 1 Prior Art
FIG. 1 schematically illustrates a hose and reel system, as known.

The present invention relates to a system for evenly winding a hose on a reel, comprising, (1) a static shaft; (2) a pulley, adapted to move along the shaft, in an oscillatory motion in ±x directions, and further adapted to receive the hose, be made to rotate by the hose, and convert a motion of the hose, in a direction substantially orthogonal to the x-axis, to a rotation of the pulley, and as a result of the rotation, to the oscillatory motion in the ±x directions; and (3) a pulley housing, configured for containing the hose within and further configured for moving along the shaft with the pulley, thus ensuring that the hose travels with the pulley, in the oscillatory motion along the shaft. Additionally, the system may include a mechanism, configured for engaging the hose with the shaft, without impeding the even winding motion.

The principles and operation of the device for evenly winding a hose on a reel, according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Figure 4:
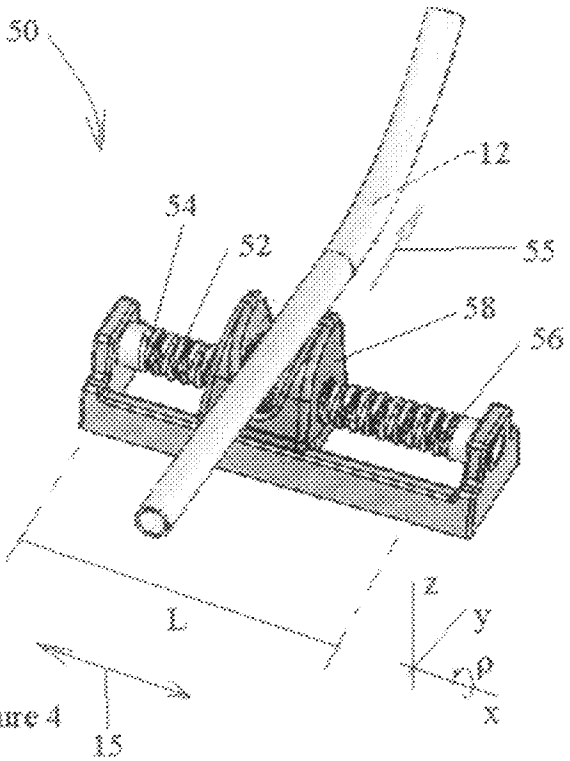
FIG. 4 schematically illustrates a device for evenly winding a hose on a reel, in accordance with a preferred embodiment of the present invention.

Referring now to the drawings, FIG. 4 schematically illustrates a device 50 for evenly winding the hose 12 on the reel 14, in accordance with a preferred embodiment of the present invention. The device 50 is designed for using the hose 12 as a belt for the transmission of the evening motion. The device 50 includes:

a shaft 52, which comprises a length, L along the x-axis and first and second ends 54 and 56, delimiting the length L, between them; and a pulley 58, adapted to move on the shaft 52, along the x-axis, and further adapted to receive the hose 12, be made to rotate by the hose 12, thus converting the motion of the hose, in a direction of an arrow 55, substantially orthogonal to the x-axis, to the rotation of the pulley 58 and as a result of the rotation, to an oscillatory motion in ±x directions, between the first and second ends 54 and 56, as shown by the arrow 15.

Referring further to the drawings, FIGS. 5A-5J schematically illustrate the device 50, in accordance with a preferred embodiment of the present invention.

Figure 5A:
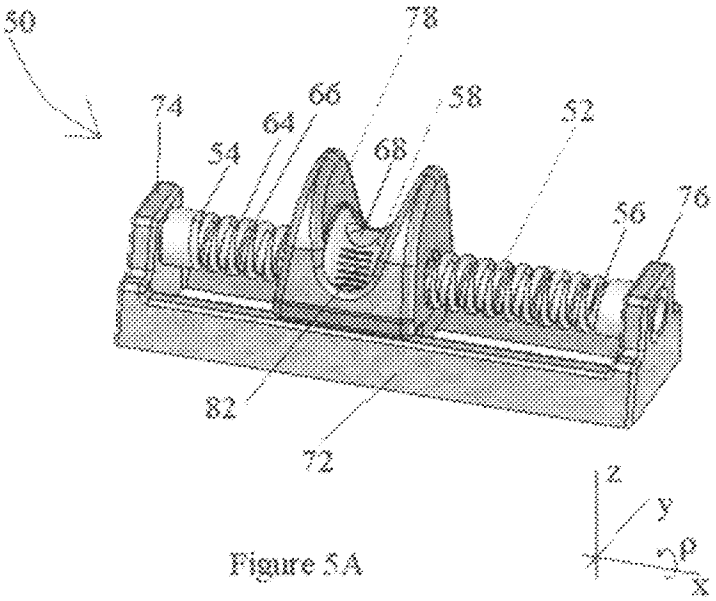
FIGS. 5A-5J schematically illustrate further the device for evenly winding a hose on a reel of FIG. 4, in accordance with a preferred embodiment of the present invention.
Figure 5E:
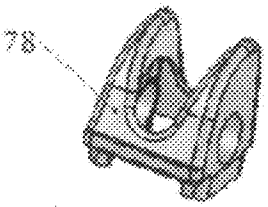
Figure 5D:
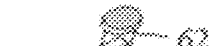
Figure 5C:
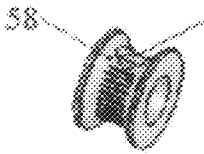
Figure 5B:
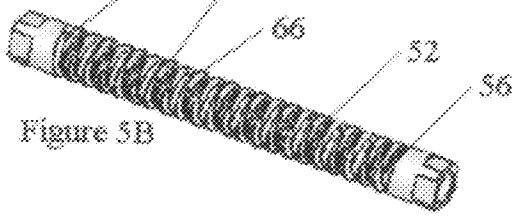

As seen in FIGS. 5A and 5B, the shaft 52 further includes first and second threads 64 and 66, running in opposite directions, and communicating between them at the first and second ends 54 and 56, so that an element (not shown) moving along the first thread 64, towards the first end 54, will be transferred to the second thread 66 at the first end 54, and an element moving along the second thread 66, towards the second end 56, will be transferred to the first thread 64 at the second end 56.

As seen in FIGS. 5A and 5C, the pulley 58 is annular and is adapted to fit over the shaft 52, and move along the shaft 52.

Figure 2A:
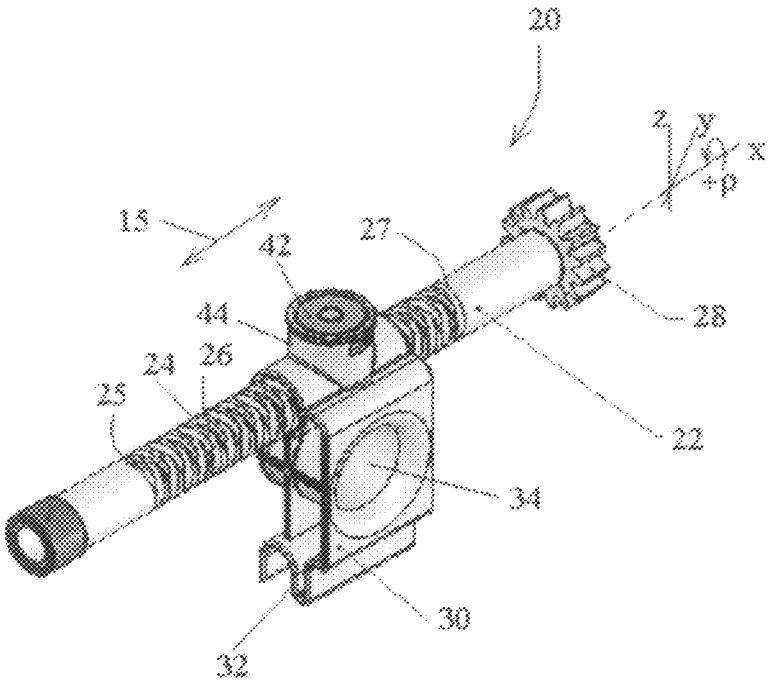
Figure 2A Prior Art
FIGS. 2A-2B schematically illustrate a rotating shaft system, for providing an oscillatory motion to a hose, for even winding, as known.
Figure 2B:
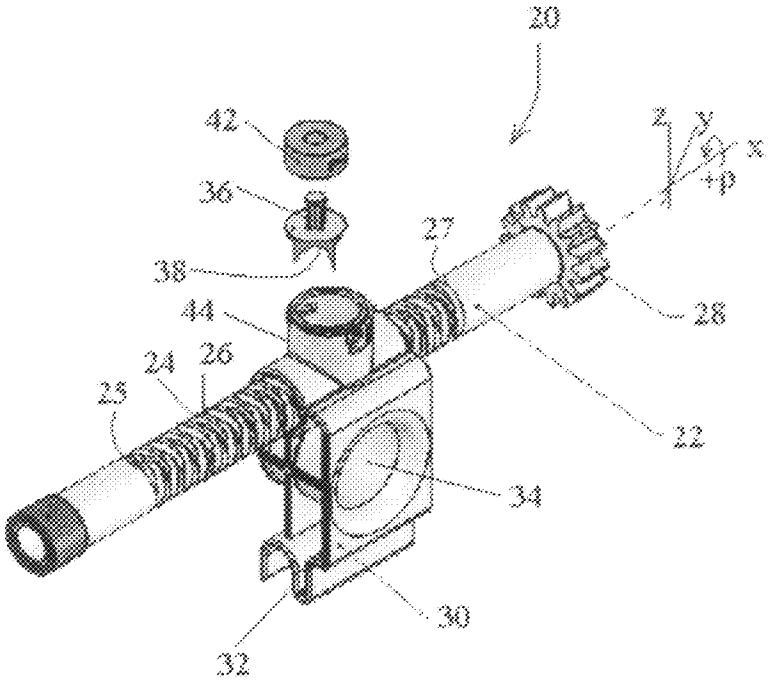
Figure 2B Prior Art
Figure 2C:
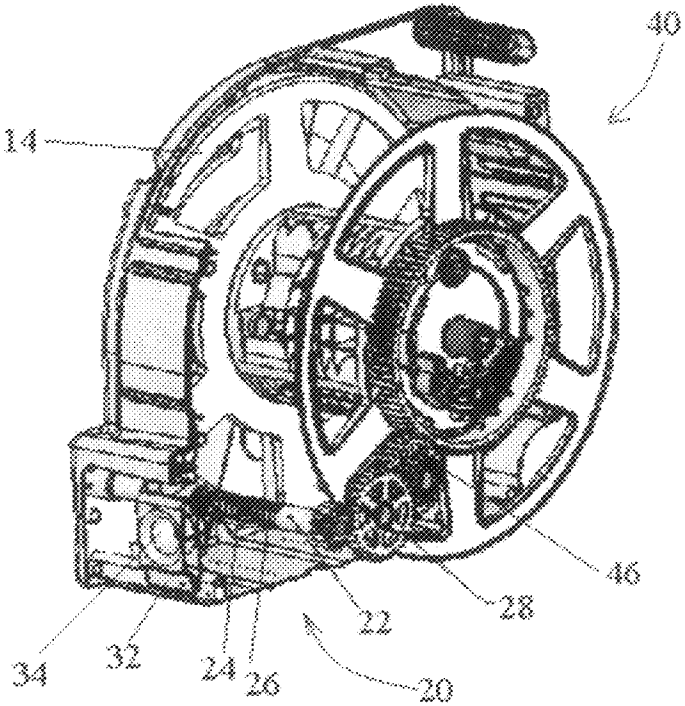
Figure 2C Prior Art
FIG. 2C schematically illustrates a reel system, for evenly winding a hose on the reel, as known.

As seen in FIGS. 5A and 5D, an arched element 62 fits within a socket 68 of the pulley 58. The arched element 62 is similar in construction to the element 36 of FIGS. 2A-2B, and has an arch 63 serving as an internal thread, which is adapted to engage with the first and second external threads 64 and 66 of the shaft 52, and is further adapted to move from the first thread 64 to the second thread 66, at the first end 54, and from the second thread 66 to the first thread 64, at the second end 56.

The structure and operation of the arched element 62 are described in FIGS. 5G-5J.

Figure 5F:
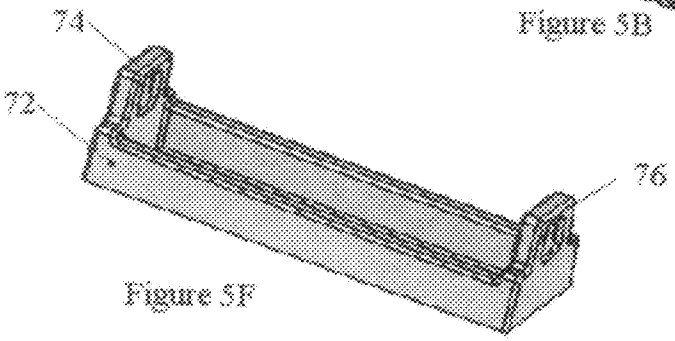
Figure 5G:
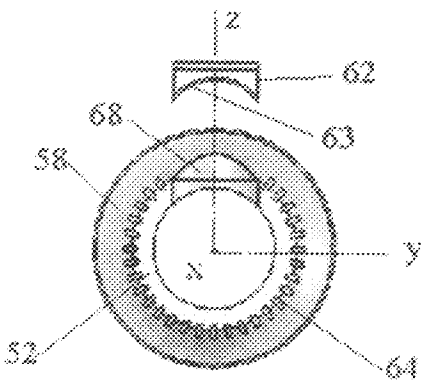

As seen in FIG. 5G the arched element 62 includes the arched segment 63, having the geometry of an internal thread which may engage either with the first external thread 64 or with the second external thread 66.

Figure 5H:
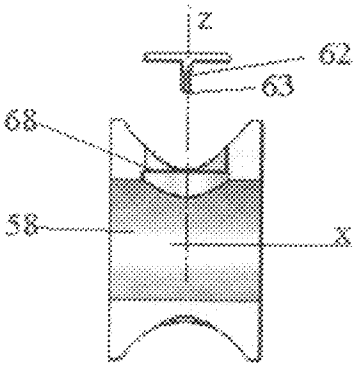

FIG. 5H provides a side view of the pulley 58 and the socket 68, as well as the arched element 62. A cap (not shown) may keep the arched element 62 in the socket 68 and prevent it from moving in the +z direction, away from the pulley 58.

Figure 5J:
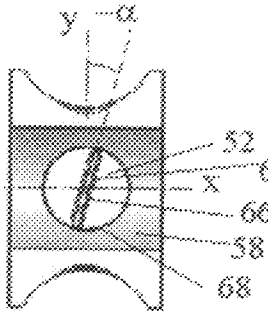
Figure 5I:
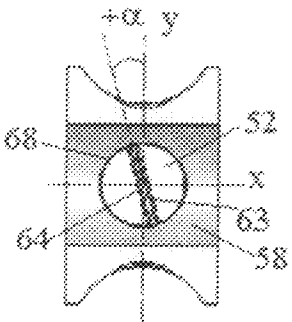

FIG. 5I schematically illustrates the arch 63, located in an angular position $+\alpha$, adapted for engagement with the right-hand, first thread 64 of the shaft 52, leading to a rotation in a clockwise direction, and FIG. 5J schematically illustrates the arch 63, located in an angular position $-\alpha$, adapted for engagement with the left-hand second thread 66 of the shaft 52, leading to rotation in a counterclockwise direction, by the arched element 62.

Thus, when the pulley 58 is made to rotate around the shaft 52, by the hose 12 (FIG. 4), in the direction of $\rho$, the arched element 62, fitted in socket 68, and being engaged with either the right-hand, first thread 64 or the left-hand second thread 66, forces the pulley to move in the oscillatory motion, in the ±x directions, between the first and second ends 54 and 56, on the first and second threads 64 and 66 of the shaft 52. In consequence, the pulley 58 also moves in the oscillatory motion, in the ±x directions, between the first and second ends 54 and 56. Thus, the hose 12, received by the pulley 58 moves with the pulley 58, in the oscillatory motion, in the ±x directions, between the first and second ends 54 and 56.

As seen in FIGS. 5A and 5E, the pulley 58 may be enclosed by a pulley housing 78 for better containing the hose 12 which is received by it.

It will be appreciated that the pulley housing 78 presents a significant improvement over the prior art, as described in German Patent Publication DE 103 00 960. The pulley housing 78 has high side walls, relative to the hose 12, and is configured for containing the hose 12 within it. The pulley housing 78 is further configured for moving along the shaft 52 with the pulley 58, thus ensuring that the hose 12 travels with the pulley 58, in the oscillatory motion, along the shaft 52.

By contrast, the roller 220 of German Patent Publication DE 103 00 960 (FIGS. 3A and 3B) has no housing for containing the cord or hose within.

As seen in FIGS. 5A and 5F, the device 50 further has a base 72, having end stops 74 and 76, for housing the shaft 52. It will be appreciated that unlike the system 20 of the prior art (FIGS. 2A-2B) the shaft 52 does not rotate. Rather, the pulley 58 rotates on the stationary shaft 52, the shaft 52 being fixed within the base 72.

Figure 6A:
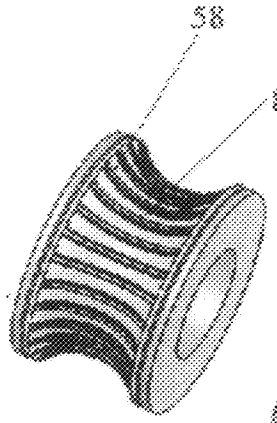
FIGS. 6A-6C schematically illustrate various pulley surfaces that may be employed by a device for evenly winding a hose on a reel, in accordance with embodiments of the present invention.
Figure 6B:
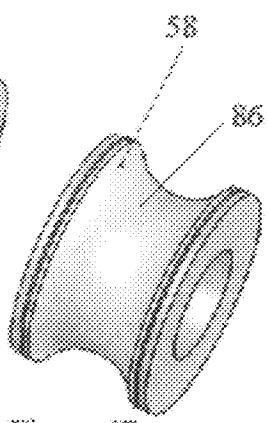
Figure 6C:
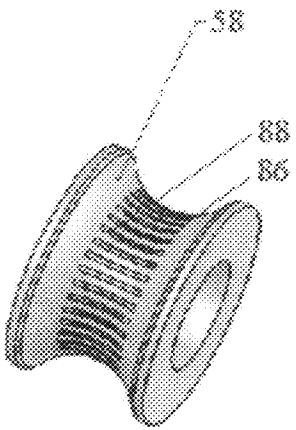

Referring further to the drawings, FIGS. 6A-6C schematically illustrate various surfaces that may be employed on the pulley 58, for creating friction between the hose 12 and the pulley 58, in accordance with embodiments of the present invention.

Since the hose 12 is operative as a belt, high frictional forces between the hose 12 and the pulley 58 is desired, to prevent slippage. The high frictional forces may be achieved by choosing surfaces of high frictional coefficients.

As seen in FIG. 6A, the pulley 58 may have groves 82 or another design for creating a rough surface to pulley 58.

As seen in FIG. 6B, the surface of the pulley 58 may be coated by an elastomer 86 such as natural or synthetic rubber, or the like, for creating a high-friction, essentially, non-slip surface.

As seen in FIG. 6C, the pulley 58 may be coated by an elastomer 86 such as natural or synthetic rubber, or the like, for creating a high-friction, essentially, non-slip surface, on which groves 88 or another pattern may be formed.

It will be appreciated that the hose 12 too may have a rough surface, for example, formed of ribs, or another pattern, in order to increase the friction between the hose 12 and the pulley 58.

It will be appreciated that many other patterns and surfaces may be employed for creating friction between the hose 12 and the pulley 58, to prevent slippage.

Figure 6D:
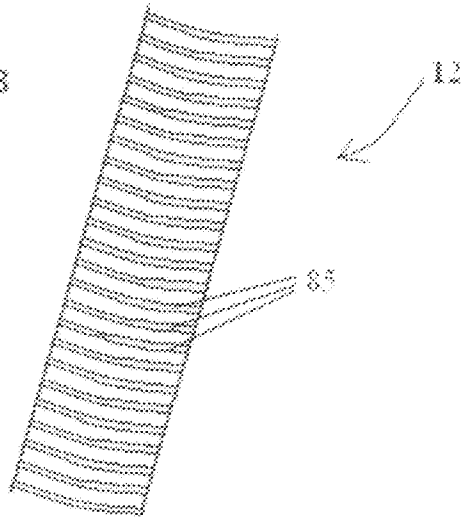
FIGS. 6D and 6E schematically illustrate a ribbed hose, operative as a toothed belt, adapted to communicate with a grooved pulley, in accordance with embodiments of the present invention.
Figure 6E:
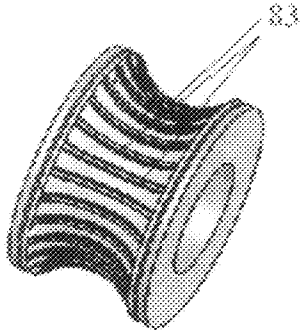

Referring further to the drawings, FIGS. 6D and 6E schematically illustrate a ribbed hose, operative as a toothed belt, adapted to communicate with a grooved pulley, in accordance with embodiments of the present invention.

Thus, as seen in FIG. 6D, the hose 12 includes ribs 85 and is operative as a toothed belt, and as seen in FIG. 6E, the pulley 58 includes grooves 83, adapted to communicate with the ribbed hose 12 and operative as a toothed-belt pulley.

It will be appreciated that other complementary hose and pulley systems may similarly be possible, for example, bumps and indentations, or other tongue and grove type arrangements.

Figures 7A, 7B:
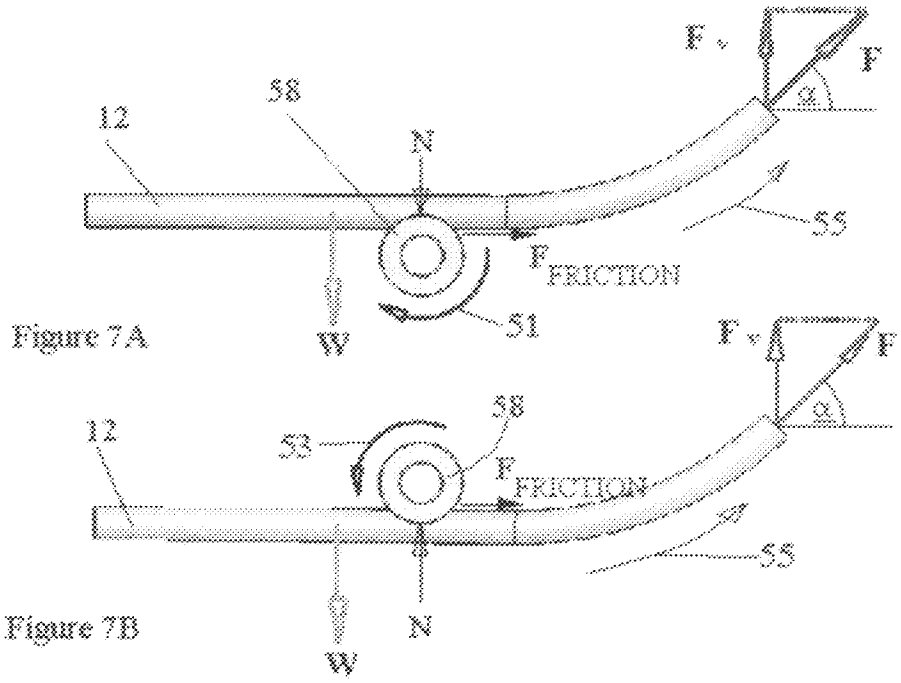
FIGS. 7A and 7B schematically illustrate two basic arrangements between a pulley and a hose, for a device for evenly winding a hose on a reel, in accordance with embodiments of the present invention.

Referring further to the drawings, FIGS. 7A and 7B schematically illustrate two basic arrangements between the pulley 58 and the hose 12, in accordance with embodiments of the present invention.

The hose 12, of a weight W, is moving in the direction of the arrow 55, as it is pulled by the reel 14, at a force F, having a vertical component $F_v$. Given a coefficient of friction $\mu$, then the frictional forces of the hose 12 on the pulley 58 are as follows:

As seen in FIG. 7A, the hose 12 is received by the pulley 58 above the pulley 58, wherein the pulley 58 rotates in the direction of an arrow 51. The normal force N excreted by the hose 12 on the pulley 58 is:

$$N=W-F_v$$

and the frictional force of the hose 12 on the pulley 58 is:

$$F_{FRICTION}=\mu(W-F_v)$$

As seen in FIG. 7B, the hose 12 is received by the pulley 58 under the pulley 58, wherein the pulley 58 rotates in the direction of an arrow 53. The normal force N excreted by the hose 12 on the pulley 58 is:

$$N=F_v-W$$

and the frictional force of the hose 12 on the pulley 58 is:

$$F_{FRICTION}=\mu(F_v-W).$$

Thus the optimal arrangement must be evaluated specifically for each case, depending on the weight of the specific hose 12, an angle $\alpha$ by which the reel 14 pulls at the hose 12 and the force F of the reel 14.

Figure 8B:
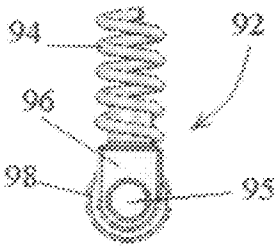
FIGS. 8A-8C schematically illustrate a helical spring arrangement for pressing a hose against a pulley, for operation with a device for evenly winding a hose on a reel, in accordance with embodiments of the present invention.
Figure 8C:
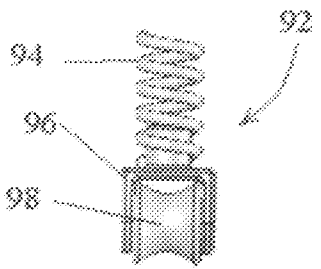
Figure 8A:
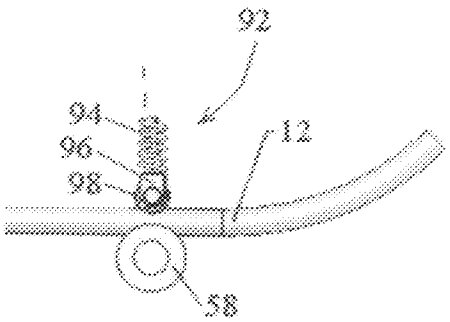

Referring further to the drawings, FIGS. 8A-8C schematically illustrate a helical spring arrangement 92 for pressing the hose 12 against the pulley 58, for operation with the device 50 for evenly winding the hose 12 on the reel 14, in accordance with embodiments of the present invention.

The helical spring arrangement 92 includes a spring 94, attached to a second pulley 98, via a pin 95 and a housing 96. The helical spring arrangement 92 is operative to maintain a pressure between the hose 12 and the pulley 58, thus increasing the normal force N (FIGS. 7A and 7B) of the hose 12 against the pulley 58, hence the frictional forces between the hose 12 and the pulley 58, preventing slippage of the hose 12 against the pulley 58, and providing a smooth operation of the device 50 (FIG. 5A).

Figure 9:
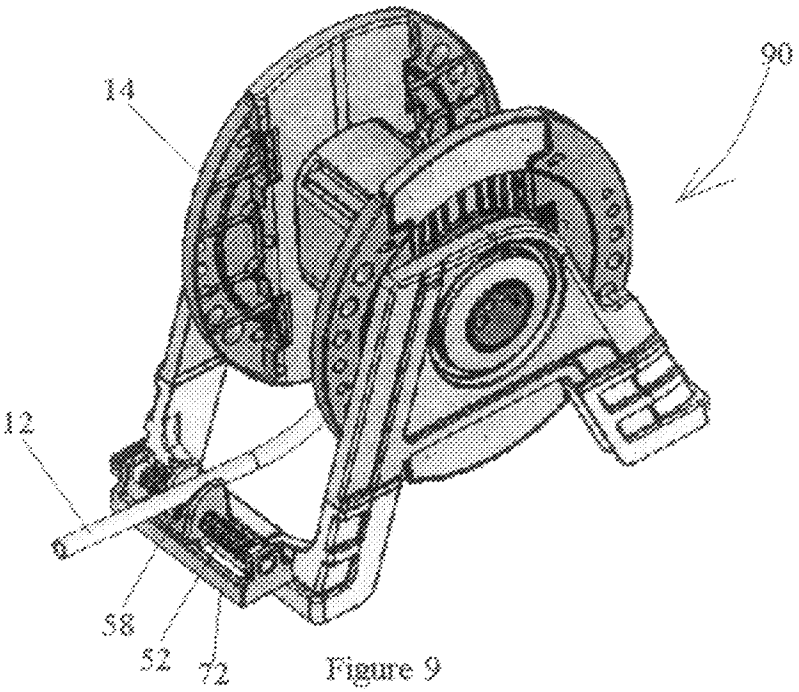
FIG. 9 schematically illustrates a system for evenly winding a hose on a reel, in accordance with a preferred embodiment of the present invention.
Figures 10A, 10B, 10C, 10D, 10E:
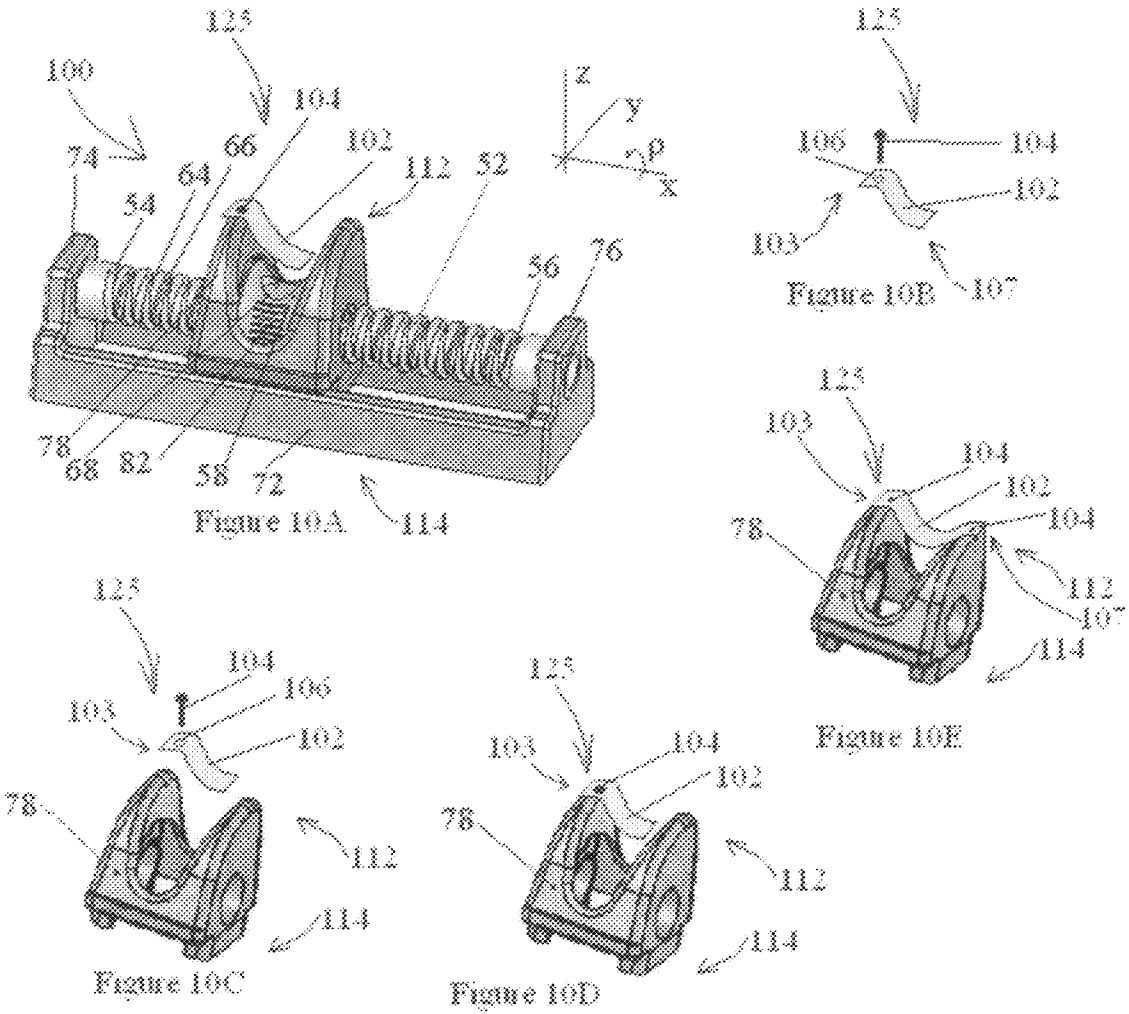
FIGS. 10A-10E schematically illustrate a device for evenly winding a hose on a reel, which includes a mechanism, for applying pressure on the hose, to engage the hose, in accordance with an embodiment of the present invention.

Referring further to the drawings, FIG. 9 schematically illustrates a system 90 for evenly winding a hose on a reel, in accordance with a preferred embodiment of the present invention.

The system 90 for evenly winding the hose 12 on the reel 14, comprises:

the reel 14, having a width along an x-axis, the reel 14 being adapted for rotation, in a direction ρ around the x-axis;

a motion provider (not shown), in mechanical communication with the reel 14, for rotating the reel 14 around the x-axis;

the hose 12, having proximal and distal ends, with respect to the reel 14, wherein the proximal end is attached to the reel 14, so that the hose 12 is wound on the reel 14 as the reel 14 is rotated by the motion provider; and the device 50 for evenly winding the hose 12 on the reel 14, comprising:

the shaft 52, which comprises:

the length L, along the x-axis; and the first and second ends 54 and 56, delimiting the length L, between them; and the pulley 58, adapted to move on the shaft 52, along the x-axis, and further adapted to receive the hose 12, be made to rotate by the hose 12, thus converting the motion of the hose 12, in a direction substantially orthogonal to the x-axis, to the rotation of the pulley and as a result of the rotation, to an oscillatory motion in ±x directions, between the first and second ends 54 and 56, so that as the reel 14 is rotated, by the motion provider, the hose 12 is pulled by the reel 14 and is wound on the reel 14, moving in the direction substantially orthogonal to the x-axis, thus rotating the pulley 58 and causing it to move in the oscillatory motion of the ±x directions, between the first and second ends 54 and 56, wherein the hose 12, received by the pulley 58, moves with the pulley 58 in the ±x directions, between the first and second ends 54 and 56, so as to wind on the reel 14, evenly along the x-axis.

It will be appreciated that the pulley 58 may be any type of roller.

Referring further to the drawings, FIGS. 10A-15F schematically illustrate devices for evenly winding a hose on a reel, which further include a mechanism 125 for engaging the hose 12 with the pulley 58, without producing excessive friction between the pulley 58 and the shaft 52, in accordance with embodiments of the present invention.

Figure 3A:
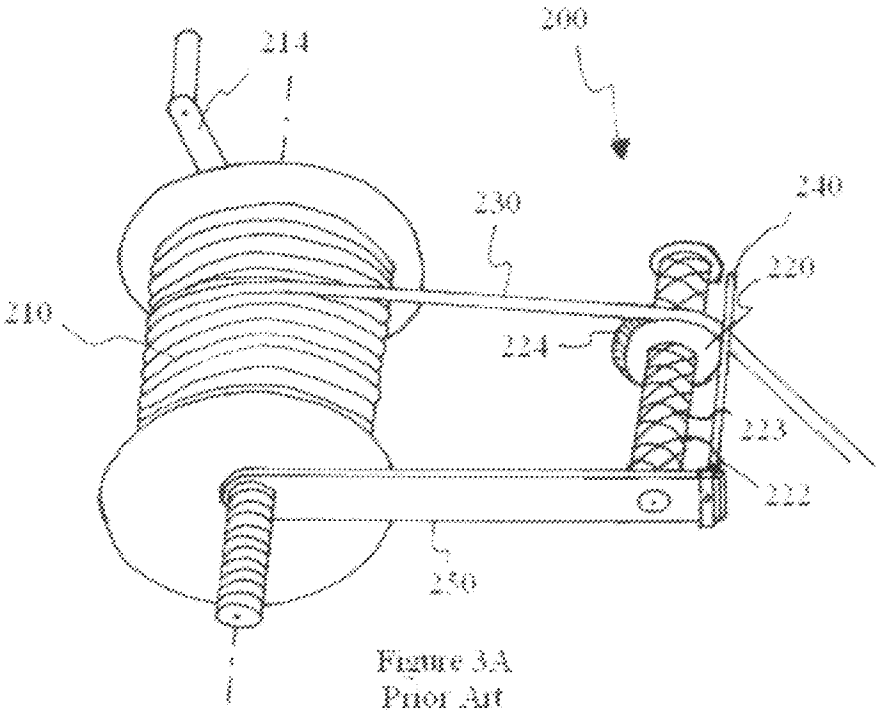
Figure 3A Prior Art
FIGS. 3A and 3B schematically illustrate a system of German Patent Publication DE 103 00 960 of Jul. 22, 2004, "Device for Winding and Unwinding Cord-Like Material"
Figure 3B:
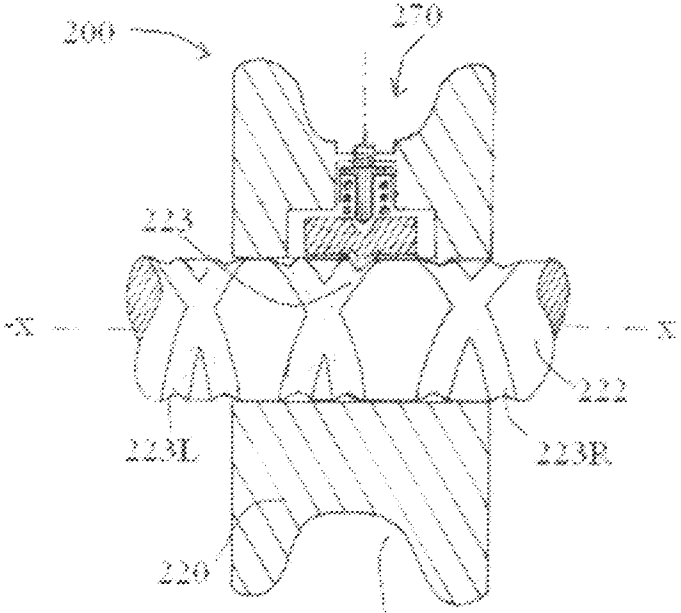

In this regard, it will be noted that the prior art, specifically, German Patent Publication DE 103 00 960 of Jul. 22, 2004, illustrated in FIGS. 3A and 3B, includes the pressure plate 240, for ensuring that the cord-like material 230 remains in place.

However, a disadvantage of the device 200 is that the pressure plate 240 increases the frictional forces between the pulley 220 and the shaft 222 of FIGS. 3A-3B, thus impeding the very motion that causes the even winding and unwinding.

In essence, the difference between the pressure plate 240 of the German Patent Publication DE 103 00 960 (FIGS. 3A and 3B) and the mechanism 125 (FIGS. 10A-15F), in accordance with embodiments of the present invention, is that the mechanism 125 of the present invention is mounted directly on the pulley housing 78 of the pulley 58 and does not apply a force onto the shaft 52. Therefore it does not increase the frictional forces between the pulley 58 and the shaft 52, and does not impede the winding motion.

FIGS. 10A-10E schematically illustrate a device 100 for evenly winding a hose on a reel, which includes the mechanism 125, for applying pressure on the hose 12, to engage the hose, in accordance with an embodiment of the present invention.

Accordingly, the pulley housing 78 of the pulley 58 defines a proximal end 114 with respect to the shaft 52, and a distal end 112.

Additionally, the device 125 is formed as a spring leaf 102, configured for applying pressure onto the hose 12 (FIG. 4). The spring leaf 102 also defines first and second ends 103 and 107, and at least one opening 106, for example, at the first end 103, for allowing a bolt 104 to pass through, attaching the spring leaf 102 to the pulley housing 78, at the distal end 112 of the pulley housing 78.

Figure 11:
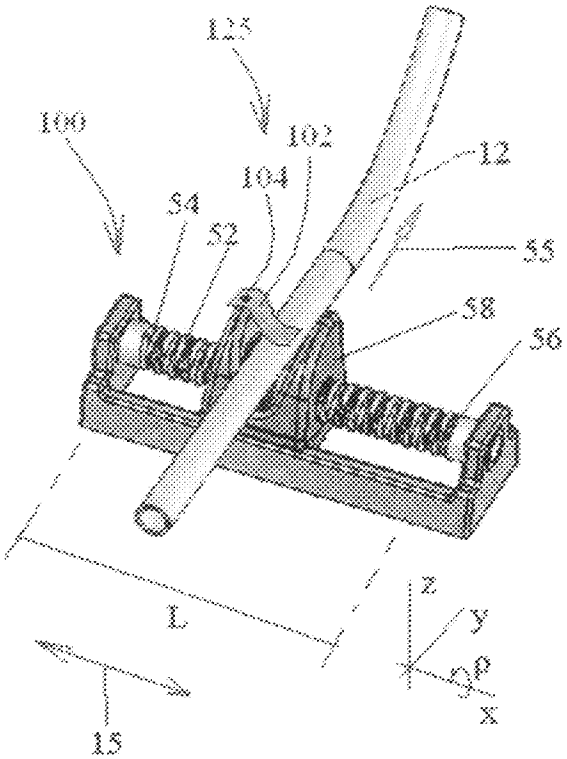
FIG. 11 schematically illustrates the device of FIGS. 10A-10D, with the hose engaged.

FIG. 11 schematically illustrates the device of FIGS. 10A-10D, with the hose 12 engaged, held in place by the spring leaf 102. The spring leaf 102 is adapted to slide over the hose 12, as the hose 12 moves in the direction of the arrow 55.

Yet the spring leaf 102 applies pressure onto the hose 12, pressing the hose 12 against the surface of the pulley 58, such as the rough surface 82, for increasing friction between the hose 12 and the pulley 58, and preventing detachment, without increasing the frictional forces between the pulley 58 and the shaft 12.

Returning to FIGS. 10A-10E, of these, FIGS. 10A-10D illustrate the spring leaf 102 attached to the pulley housing 78 only at its first end 103, in accordance with one embodiment of the present invention, while FIG. 10E illustrates the spring leaf 102 attached at the two ends 103 and 107 to the pulley housing 78, in accordance with another embodiments of the present invention.

Figure 12B:
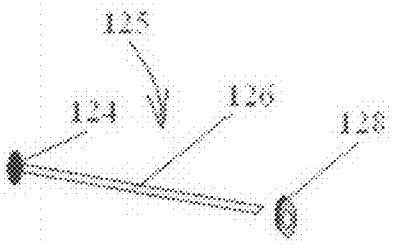
FIGS. 12A-12C schematically illustrate the device for evenly winding a hose on a reel, with the mechanism, in accordance with another embodiment of the present invention.
Figure 12C:
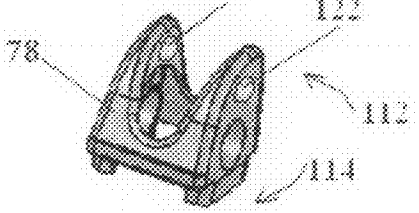
Figure 12A:
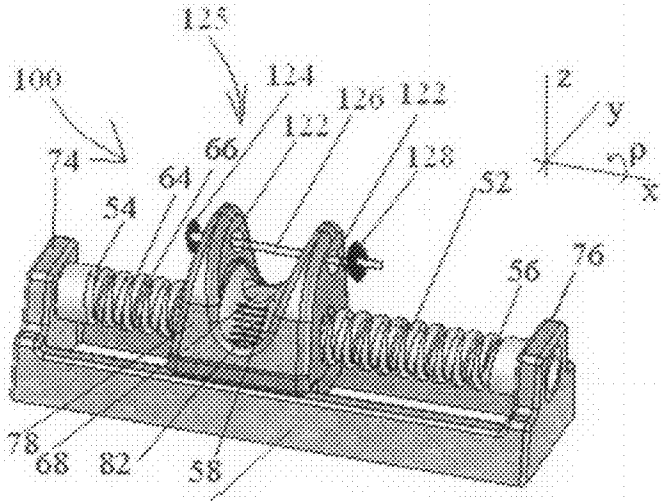
Figure 12:
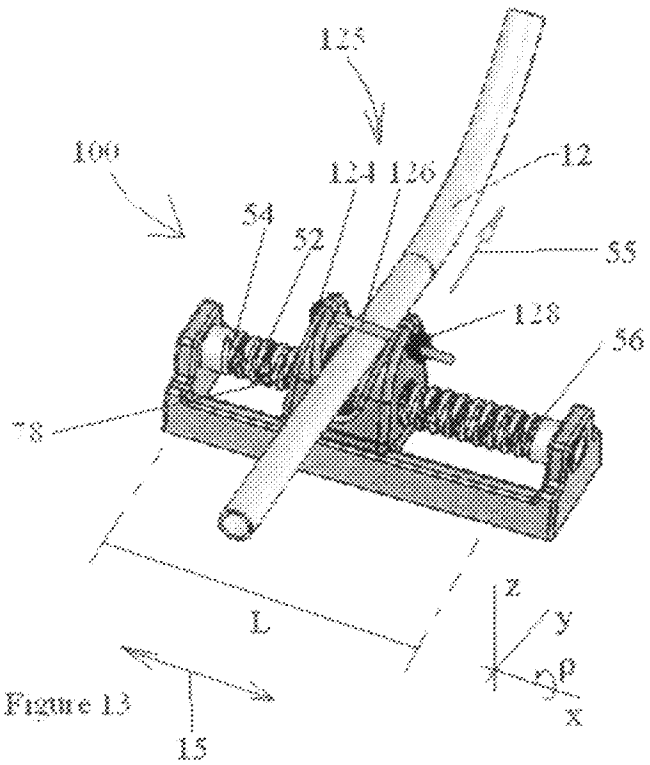

FIGS. 12A-12C schematically illustrate the device 100 for evenly winding a hose on a reel, with the mechanism 125, in accordance with another embodiment of the present invention.

In the present embodiment, the pulley housing 78 of the pulley 58 defines bores 122 at the distal end 112. The mechanism 125 is formed as a rod 126, preferably of a circular cross-section, fitted through the bores 122 of the pulley housing 78, and held in place by nuts 124 and 128.

FIG. 13 schematically illustrates the device 100 of FIGS. 12A-12C, with the hose 12 in place. Preferably, the rod 126 fits loosely within the bores 122, so that it may roll easily, along the hose 12, as the hose 12 moves in the direction of the arrow 55.

It will be appreciated that the rod 126 may be of a different cross section. For example, the rod 126 may have a rectangular cross section, with a flat side, which may slide along the hose 12.

Figures 14A, 14B, 14C:
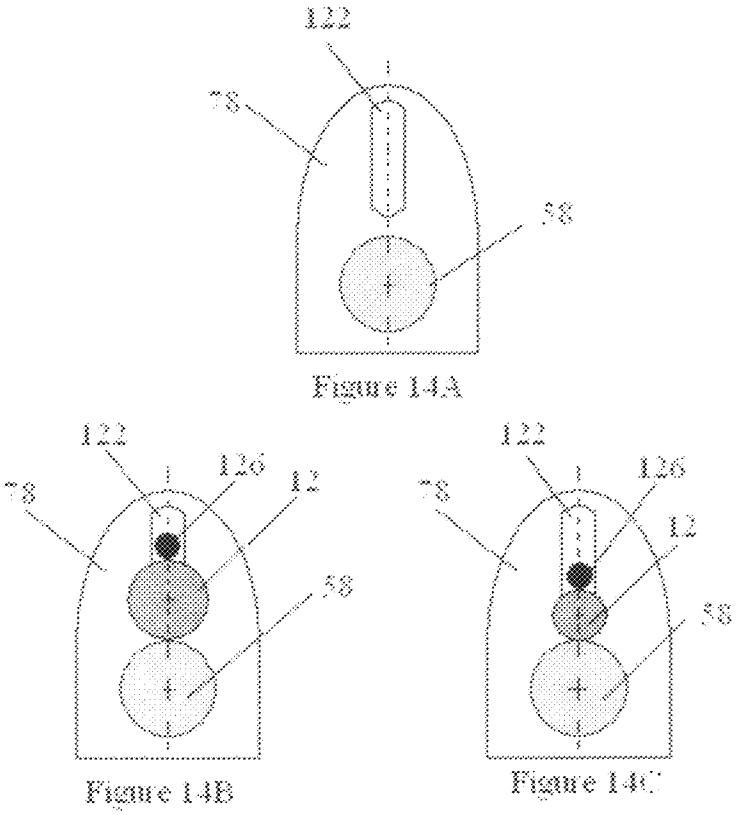
FIGS. 14A-14C schematically illustrate the housing with slits in place of bores for accommodating hoses of different diameters, in accordance with yet another embodiment of the present invention.

FIGS. 14A-14C schematically illustrate the pulley housing 78 with slits 122 in place of bores, for accommodating hoses 12 of different diameters, in accordance with yet another embodiment of the present invention.

Thus, FIGS. 14B and 14C illustrate situations with large and small diameter hoses 12 respectively, with the rod 126, positioned in the slit 122 so as to sit directly on the hose 12, which is engaged with the pulley 58.

FIGS. 15A-15F schematically illustrate the mechanism 125, which contains the helical spring arrangement 92 of FIGS. 8A-8C, in accordance with still another embodiment of the present invention.

According to the present embodiment, the pulley housing 78 of the pulley 58 defines the bores 122. The mechanism 125 includes a head piece 130, with complementary bores 132, configured for positioning on the pulley housing 78, and attached thereto, for example, with bolts 136 and nuts 138, fitted through the bores 132 and 122, as seen in FIG. 15F.

Figure 15A:
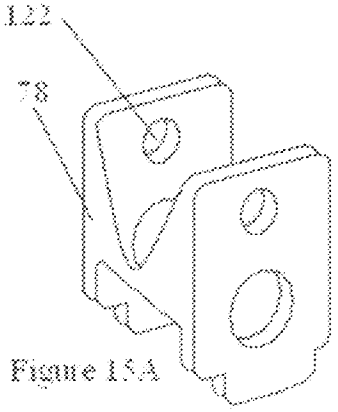
FIGS. 15A-15F schematically illustrate the mechanism, which contains the helical spring arrangement of FIGS. 8A-8C, in accordance with still another embodiment of the present invention.
Figure 15B:
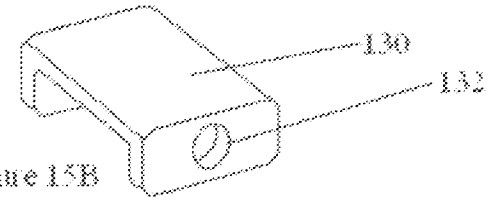
Figure 15C:
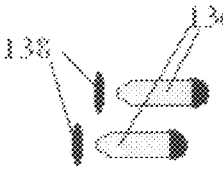
Figure 15D:
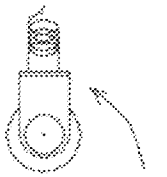
Figure 15E:
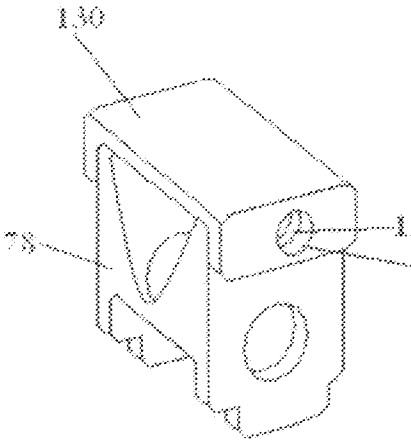
Figure 15F:
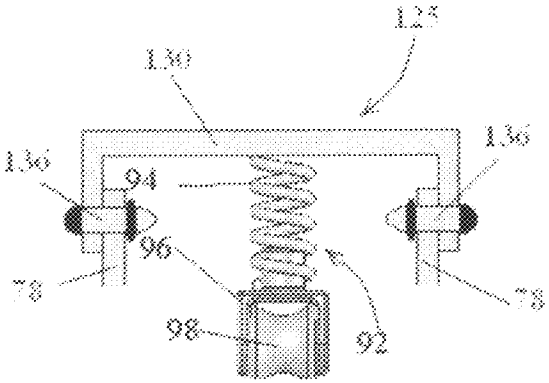

The helical spring arrangement 92 is attached to the head piece 130, as seen in FIG. 15F, for pressing against the hose 12 to engage it with the pulley 58, as seen in FIG. 8A.

It is expected that during the life of this patent many relevant devices for evenly winding a hose on a reel will be developed and the scope of the term, a device for evenly winding a hose on a reel, is intended to include all such new technologies a priori.

As used herein the term "about" refers to ±20%.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, any citation or identification of any reference in this application shall not be construed as an admission that such reference is available as prior art to the present invention.

What is claimed is:

1. A device for evenly winding a hose on a reel, the device comprising:

said reel having a first reel end and a second reel end along a first axis and rotating about said first axis to wind said hose about said reel between said first reel end and said second reel end;

a threaded static axis parallel to said first axis and having a first static axis end and a second static axis end, and a pulley threadably located on said static axis for rotary motion and an oscillatory motion back and forth along said static axis between said first static axis end and said second static axis end, an open pulley housing being mounted on said pulley, said pulley being rotatable with respect to said open pulley housing, and the open pulley housing configured to partially enclose said hose;

said hose wound about said reel and extending towards said pulley to thread through said open housing, the open pulley housing comprising a hose engagement mechanism mounted therein, the open pulley housing and the hose engagement mechanism moving with said pulley in said oscillatory motion but prevented from rotating with respect to said static axis, said hose engagement mechanism being configured to push said hose against said pulley to cause a frictional force preventing slippage between said hose and said pulley, said frictional force thereby causing a motion of said hose between said first static axis end and said second static axis end to drive said pulley along said threaded static axis in said oscillatory motion to wind said hose evenly over said reel between said first reel end and said second reel end.

2. The device of claim 1, wherein said pulley housing and said pulley are each designed to accept hoses of different diameters, and wherein said hose engagement mechanism is configured to travel along slits in said pulley housing so as to push against said hose in accordance with a respective hose diameter.

3. The device of claim 1, wherein:

said static axis further includes first and second threads, running in opposite directions, and communicating between them at said first and second ends, so that an element moving along said first thread, towards said first end, will be transferred to said second thread at said first end, and an element moving along said second thread, towards said second end, will be transferred to said first thread at said second end; and said pulley is annular, having an element with an arched segment, said arched element serving as an internal thread and being adapted for engagement with first and second external threads, so that when said pulley is made to rotate around said axis, by said hose, said pulley moves in said rotary motion, in ±x directions, between said first and second ends, on said first and second threads.

4. The device of claim 1, wherein said pulley has a patterned surface for creating high friction between said hose and said pulley.

5. The device of claim 1, wherein said pulley has an elastomer surface for creating high friction between said hose and said pulley.

6. The device of claim 1, wherein said pulley has an elastomer and a patterned surface for creating high friction between said hose and said pulley.

7. The device of claim 1, wherein said hose is ribbed and is operative as a toothed belt, and wherein said pulley is adapted to communicate with said ribbed hose, and is operative as a toothed-belt pulley.

8. The device of claim 1, wherein said hose has a patterned surface, and said pulley has a complementary surface, adapted to engage with said hose.

9. The device of claim 1, wherein said hose has a rough surface, for increased friction with said pulley.

10. A system for evenly winding a hose on a reel, comprising:

said reel having a first reel end and a second reel end and rotating about a first reel axis to wind said hose about said reel between said first reel end and said second reel end;

a threaded static axis parallel to said reel and having a first static axis end and a second static axis end, and a pulley threadably located on said static axis for rotary motion together with an oscillatory motion back and forth along said static axis between said first static axis end and said second static axis end, an open pulley housing mounted on said pulley to oscillate with said pulley, said pulley being rotatable with respect to said open pulley housing, the open pulley housing comprising a friction surface, the open pulley housing further configured for said hose to be threaded therethrough, wherein said open pulley housing partially encloses said hose;

said hose wound about said reel and threaded through said open pulley housing to run over said pulley, the open pulley housing comprising a hose engagement mechanism mounted therein to grip said hose, the open pulley housing and the hose engagement mechanism therewithin oscillating with rotation of said pulley but being prevented by said hose threaded therein from rotating with respect to said static axis, wherein pressure on said hose exerted by said hose engagement mechanism within said open pulley housing causes a frictional force preventing slippage between said hose and said pulley, said frictional force causing a motion of said hose to drive said pulley along said threaded static axis in said oscillatory motion, between said first static axis end and said second static axis end, to wind said hose evenly over said reel between said first reel end and said second reel end; and a motion provider, in mechanical communication with said reel, for rotating said reel around said first reel axis.

11. The system of claim 10, wherein said pulley housing and said pulley are each designed to accept hoses of different diameters, and wherein said hose engagement mechanism is configured to travel along slits in said pulley housing so as to push against said hose in accordance with a respective hose diameter.

12. The system of claim 10, wherein:

said axis further includes first and second threads, running in opposite directions, and communicating between them at said first and second ends, so that an element moving along said first thread, towards said first end, will be transferred to said second thread at said first end, and an element moving along said second thread, towards said second end, will be transferred to said first thread at said second end; and said pulley is annular, having an element with an arched segment, said arched element serving as an internal thread and being adapted for engagement with first and second external threads, so that when said pulley is made to rotate around said axis, by said hose, said pulley moves in said rotary motion, in said ±x directions, between said first and second ends, on said first and second threads.

13. The system of claim 10, wherein said pulley has a patterned surface for creating high friction between said hose and said pulley.

14. The system of claim 10, wherein said pulley has an elastomer surface for creating high friction between said hose and said pulley.

15. The system of claim 10, wherein said pulley has an elastomer and a patterned surface for creating high friction between said hose and said pulley.

16. The system of claim 10, wherein said hose is ribbed and is operative as a toothed belt, and wherein said pulley is adapted to communicate with said ribbed hose, and is operative as a toothed-belt pulley.

17. The system of claim 10, wherein said hose has a patterned surface, and said pulley has a complementary surface, adapted to engage with said hose.

18. The system of claim 10, wherein said hose has a rough surface, for increased friction with said pulley.

* * * * *